US008245528B2

(12) United States Patent
Sakitani et al.

(10) Patent No.: US 8,245,528 B2
(45) Date of Patent: Aug. 21, 2012

(54) FLUID MACHINE

(75) Inventors: Katsumi Sakitani, Osaka (JP); Masakazu Okamoto, Osaka (JP); Eiji Kumakura, Osaka (JP); Tetsuya Okamoto, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 1020 days.

(21) Appl. No.: 12/224,777

(22) PCT Filed: Mar. 5, 2007

(86) PCT No.: PCT/JP2007/054187

§ 371 (c)(1),
(2), (4) Date: Sep. 5, 2008

(87) PCT Pub. No.: WO2007/119307

PCT Pub. Date: Oct. 25, 2007

(65) Prior Publication Data

US 2009/0100860 A1 Apr. 23, 2009

(30) Foreign Application Priority Data

Mar. 17, 2006 (JP) ..... 2006-074912

(51) Int. Cl.
*F25B 43/02* (2006.01)

(52) U.S. Cl. ..... 62/468

(58) Field of Classification Search ..... 62/126, 62/224, 225, 468, 527, 528, 238.6
See application file for complete search history.

(56) References Cited

U.S. PATENT DOCUMENTS 7,628,592 B2 12/2009 Okamoto et al.

FOREIGN PATENT DOCUMENTS

| | | | |
|---|---|---|---|
| JP | 2005-264748 | * | 9/2005 |
| JP | 2005-264748 A | | 9/2005 |
| JP | 2005-299632 | * | 10/2005 |
| JP | 2005-299632 A | | 10/2005 |
| WO | WO-2005/088078 A1 | | 9/2005 |

* cited by examiner

*Primary Examiner* — Frantz Jules
*Assistant Examiner* — Emmanuel Duke
(74) *Attorney, Agent, or Firm* — Birch, Stewart, Kolasch & Birch, LLP.

(57) ABSTRACT

In a compression/expansion unit (30) serving as a fluid machine, both of a compression mechanism (50) and an expansion mechanism (60) are contained in a single casing (31). A shaft (40) coupling the compression mechanism (50) to the expansion mechanism (60) has an oil feeding channel (90) formed therein. Refrigerating machine oil accumulated at the bottom of the casing (31) is sucked up into the oil feeding channel (90) and fed to the compression mechanism (50) and the expansion mechanism (60). The refrigerating machine oil fed to the expansion mechanism (60) is discharged from the expansion mechanism (60) together with the refrigerant after expansion, flows through the refrigerant circuit and then flows back to the compression mechanism (50) in the compression/expansion unit (30).

4 Claims, 5 Drawing Sheets

FLUID MACHINE

TECHNICAL FIELD

This invention relates to fluid machines in which a compression mechanism and an expansion mechanism are contained in a single casing.

BACKGROUND ART

Fluid machines are conventionally known in which an expansion mechanism, an electric motor and a compression mechanism are coupled by a single rotary shaft. In such a fluid machine, the expansion mechanism generates power by expanding fluid introduced thereinto. The power generated by the expansion mechanism, together with power generated by the electric motor, is transmitted to the compression mechanism by the rotary shaft. Then, the compression mechanism is driven by the power transmitted from the expansion mechanism and the electric motor to suck fluid and compress it.

For example, Patent Document 1 discloses a fluid machine in which an expansion mechanism, an electric motor, a compression mechanism and a rotary shaft are contained in a vertically long, cylindrical casing. In the casing of the fluid machine, the expansion mechanism, the electric motor and the compression mechanism are disposed in bottom to top order and coupled to each other by the single rotary shaft. The expansion mechanism and the compression mechanism are both constituted by rotary fluid machines.

In the fluid machine in Patent Document 1, the rotary shaft has an oil feeding channel formed therein. Through the oil feeding channel in the rotary shaft, lubricating oil accumulated at the bottom of the casing is fed to the expansion mechanism disposed in an upper part of the casing. In this fluid machine, the expansion mechanism is provided with an oil return passage so that surplus lubricating oil is sent through the oil return passage back to the bottom of the casing.

Patent Document 1: Published Japanese Patent Application No. 2005-299632

DISCLOSURE OF THE INVENTION

Problems to be Solved by the Invention

As described above, the fluid machine in Patent Document 1 is provided with an oil return passage for returning lubricating oil from the expansion mechanism side to the compression mechanism side therethrough. Therefore, the structure of the fluid machine is complicated correspondingly to the provision of the oil return passage, which may invite adverse effects, such as rise in production cost.

The present invention has been made in view of the foregoing point and, therefore, an object of the invention is to simplify the structure of a fluid machine including a compression mechanism and an expansion mechanism.

Means to Solve the Problems

A first aspect of the invention is directed to a fluid machine disposed in a refrigerant circuit (20) operating in a refrigeration cycle by circulating refrigerant therethrough. Furthermore, the fluid machine includes: a compression mechanism (50) for compressing the refrigerant; an expansion mechanism (60) for generating power by expansion of the refrigerant; a rotary shaft (40) coupling the compression mechanism (50) to the expansion mechanism (60); and a container-shaped casing (31) containing the compression mechanism (50), the expansion mechanism (60) and the rotary shaft (40), the rotary shaft (40) having an oil feeding channel (90) formed therein to feed lubricating oil accumulated in part of the casing (31) located towards the compression mechanism (50) to the expansion mechanism (60), the expansion mechanism (60) being configured to introduce the lubricating oil fed through the oil feeding channel (90) into an expansion chamber (72, 82) for expanding the refrigerant therein and discharge the lubricating oil together with the refrigerant after expansion.

In the first aspect of the invention, the fluid machine (30) is disposed in a refrigerant circuit (20). Refrigerant compressed by the compression mechanism (50) of the fluid machine (30) releases heat in a heat exchanger for heat release and then flows into the expansion mechanism (60) of the fluid machine (30). In the expansion mechanism (60), high-pressure refrigerant having flowed thereinto expands. Power recovered from the high-pressure refrigerant in the expansion mechanism (60) is transmitted to the compression mechanism (50) by the rotary shaft (40) and used to drive the compression mechanism (50). The refrigerant having expanded in the expansion mechanism (60) takes heat in a heat exchanger for heat absorption and is then sucked into the compression mechanism (50) of the fluid machine (30).

In the fluid machine (30) according to the first aspect of the invention, lubricating oil is accumulated in part of the internal space of the casing (31) located towards the compression mechanism (50). The lubricating oil in the casing (31) is fed through the oil feeding channel (90) formed in the rotary shaft (40) to the expansion mechanism (60) and used to lubricate the expansion mechanism (60). The lubricating oil fed to the expansion mechanism (60) flows into the expansion chamber in the expansion mechanism (60). In the expansion chamber of the expansion mechanism (60), refrigerant expands. The lubricating oil having flowed into the expansion chamber, together with the refrigerant after expansion, is discharged from the expansion mechanism (60). The lubricating oil discharged from the expansion mechanism (60), together with the refrigerant, flows through the refrigerant circuit (20) and then flows into the fluid machine (30). In other words, the lubricating oil fed to the expansion mechanism (60) is once discharged from the fluid machine (30), passes through the refrigerant circuit (20) and then returns into the casing (31) of the fluid machine (30).

A second aspect of the invention is the fluid machine according to the first aspect of the invention, wherein the expansion mechanism (60) is constituted by a rotary expander including: a cylinder (71, 81) both ends of which are closed; a piston (75, 85) engaged with the rotary shaft (40) and contained in the cylinder (71, 81) to form the expansion chamber (72, 82); and a blade (76, 86) for partitioning the expansion chamber (72, 82) into a high-pressure chamber and a low-pressure chamber, the rotary shaft (40) has a branch channel (93) formed therein to be branched from the oil feeding channel (90) and open at the outer periphery of the rotary shaft (40), and the expansion mechanism (60) has an oil introduction channel (114) formed to introduce the lubricating oil discharged through the branch channel (93) to the sliding surface of the blade (76, 86).

In the second aspect of the invention, the expansion mechanism (60) is constituted by a rotary expander. When in the expansion mechanism (60) refrigerant introduced into the expansion chamber (72, 82) expands, the piston (75, 85) moves to drive the rotary shaft (40). The lubricating oil flowing through the oil feeding channel (90) towards the expansion mechanism (60) partly flows into the branch channel (93). The lubricating oil having flowed into the branch channel (93) is discharged from the branch channel (93) by a centrifugal force due to the rotation of the rotary shaft (40). The lubricating oil discharged from the branch channel (93) is fed through the oil introduction channel (114) to the sliding surface of the blade (76, 86) and used to lubricate the blade (76, 86).

A third aspect of the invention is the fluid machine according to the second aspect of the invention, wherein the cylinder (71, 81) has a through hole (78, 88) formed therein to pass through the cylinder (71, 81) in a thickness direction of the cylinder (71, 81) and receive the blade (76, 86), the oil introduction channel (114) opens into the through hole (78, 88) in the cylinder (71, 81) to feed the lubricating oil to the sliding surface of the blade (76, 86), one end of the oil feeding channel (90) opens at an end surface of the rotary shaft (40) closer to the expansion mechanism (60), and the expansion mechanism (60) has a connection channel (111) formed to communicate the through hole (78, 88) in the cylinder (71, 81) with the one end of the oil feeding channel (90) opening at the end surface of the rotary shaft (40).

In the third aspect of the invention, the lubricating oil is introduced through the oil introduction channel (114) into the through hole (78, 88) in the cylinder (71, 81) and the lubricating oil having flowed into the through hole (78, 88) is fed to the sliding surface of the blade (76, 86). Furthermore, the lubricating oil in the through hole (78, 88) is discharged through the connection channel (111) to the oil feeding channel (90) in the rotary shaft (40).

A fourth aspect of the invention is the fluid machine according to the first, second or third aspect of the invention, wherein the internal space of the casing (31) is partitioned into a first space (38) in which the expansion mechanism (60) is contained and a second space (39) in which the compression mechanism (50) is contained and to which compressed refrigerant is discharged from the compression mechanism (50), and the fluid machine is configured so that the lubricating oil accumulated in the second space (39) is fed through the oil feeding channel (90) to the expansion mechanism (60).

In the fourth aspect of the invention, the lubricating oil is accumulated in the second space (39) in the casing (31) (i.e., a space therein filled with high-temperature and high-pressure refrigerant discharged from the compression mechanism (50)). The refrigerant being sucked into the compression mechanism (50) flows into the compression mechanism (50) without contact with the refrigerant in the second space (39). Therefore, the lubricating oil discharged from the expansion mechanism (60) and returned through the refrigerant circuit (20) to the compression mechanism (50) also directly flows into the compression mechanism (50) without contact with the refrigerant in the second space (39).

A fifth aspect of the invention is the fluid machine according to the first, second, third or fourth aspect of the invention, wherein the rotary shaft (40) is provided with a non-positive displacement oil pump (94) that, by the rotation of the rotary shaft (40), sucks the lubricating oil and discharges the sucked lubricating oil to the oil feeding channel (90).

In the fifth aspect of the invention, the rotary shaft (40) is provided with an oil pump (94). When the rotary shaft (40) rotates, the oil pump (94) accordingly sucks the lubricating oil in the casing (31) and discharges it to the oil feeding channel (90). The oil pump (94) is constituted by a non-positive displacement pump. Therefore, the amount of lubricating oil discharged from the oil pump (94) is influenced, unlike positive displacement pumps, not only by the rotational speed of the rotary shaft (40) but also by the internal pressure of the oil feeding channel (90) and the internal pressure of the casing (31).

A sixth aspect of the invention is the fluid machine according to the first, second, third or fourth aspect of the invention, being disposed in the refrigerant circuit (20) filled with carbon dioxide as refrigerant and configured so that the compression mechanism (50) compresses the sucked refrigerant to the critical pressure or higher and the expansion mechanism (60) expands high-pressure refrigerant of critical pressure or higher having flowed thereinto.

In the sixth aspect of the invention, carbon dioxide as the refrigerant circulates through the refrigerant circuit (20) in which the fluid machine (30) is connected. The compression mechanism (50) of the fluid machine (30) compresses sucked refrigerant to the critical pressure or higher and then discharges it. On the other hand, high-pressure refrigerant of critical pressure or higher is introduced into the expansion mechanism (60) of the fluid machine (30) and expands therein.

Effects of the Invention

In the fluid machine (30) according to the present invention, the lubricating oil fed to the expansion mechanism (60) is sent, through the refrigerant circuit (20) in which the fluid machine (30) is connected, back to the inside of the casing (31). In other words, even if the fluid machine (30) itself is not provided with a passage or the like for returning the lubricating oil from the expansion mechanism (60) side in the casing (31) to the compression mechanism (50) side therein, the lubricating oil fed to the expansion mechanism (60) is sent back to the inside of the casing (31). Therefore, according to the present invention, any passage or the like for returning the lubricating oil from the expansion mechanism (60) side in the casing (31) to the compression mechanism (50) side therein can be eliminated from the fluid machine (30), which simplifies the structure of the fluid machine (30).

According to the second aspect of the invention, the lubricating oil can be fed to the sliding surface of the blade (76, 86) using a centrifugal force caused by the rotation of the rotary shaft (40). Therefore, the sliding surface of the blade (76, 86) can be certainly lubricated, which enhances the reliability of the fluid machine (30).

In the third aspect of the invention, the fluid machine has a flow path for lubricating oil formed to allow the oil to flow from the oil feeding channel (90), through the branch channel (93), the oil introduction channel (114), the through hole (78, 88) and the connection channel (111) in this order and back to the oil feeding channel (90). Therefore, according to this aspect of the invention, the lubricating oil can be more certainly fed to the sliding surface of the blade (76, 86), which further enhances the reliability of the fluid machine (30).

In the fourth aspect of the invention, the lubricating oil discharged from the expansion mechanism (60) directly flows into the compression mechanism (50) without contact with high-temperature and high-pressure refrigerant discharged from the compression mechanism (50) to the second space (39).

In the fluid machine (30), refrigerant at a relatively high temperature (for example, about 90° C.) is discharged from the compression mechanism (50), while refrigerant at, for example, about 40° C., expands in the expansion mechanism (60) to reduce its temperature down to, for example, about 5° C. Therefore, the temperature of lubricating oil having passed through the expansion mechanism (60) is not so high. Hence, if, as in conventional fluid machines, lubricating oil having passed through the expansion mechanism were sent back to a space in the casing located towards the compression mechanism, refrigerant discharged from the compression mechanism to the space would be cooled by the lubricating oil sent back from the expansion mechanism to the space. In other words, the enthalpy of refrigerant compressed by the compression mechanism and discharged from the fluid machine would be reduced. As a result, in the case of heating an object with high-pressure refrigerant discharged from the fluid machine, the amount of heat applied to the object might be reduced.

In contrast, in the fluid machine (30) according to the fourth aspect of the invention, the lubricating oil discharged from the expansion mechanism (60) is directly sucked into the compression mechanism (50). In other words, relatively low-temperature lubricating oil discharged from the expansion mechanism (60) flows into the compression mechanism (50) without contact with high-temperature and high-pressure refrigerant discharged from the compression mechanism (50) to the second space (39). Therefore, according to this aspect of the invention, it can be avoided that the refrigerant discharged from the compression mechanism (50) is cooled by the lubricating oil discharged from the expansion mechanism (60). As a result, in heating an object with the refrigerant discharged from the compression mechanism (50), the heating capacity can be enhanced.

Furthermore, in the fifth aspect of the invention, the oil pump (94) is constituted by a non-positive displacement pump. Therefore, the amount of lubricating oil fed to the oil feeding channel (90) by the oil pump (94) varies not only with the rotational speed of the rotary shaft (40) but also with the internal pressure of the oil feeding channel (90) and the internal pressure of the casing (31). Therefore, according to this aspect of the invention, the amount of lubricating oil fed through the oil feeding channel (90) to the expansion mechanism (60) can be appropriately controlled according to the operating conditions of the fluid machine (30). As a result, the amount of lubricating oil discharged from the expansion mechanism (60) together with refrigerant can be reduced.

LIST OF REFERENCE NUMERALS

Figure 1:
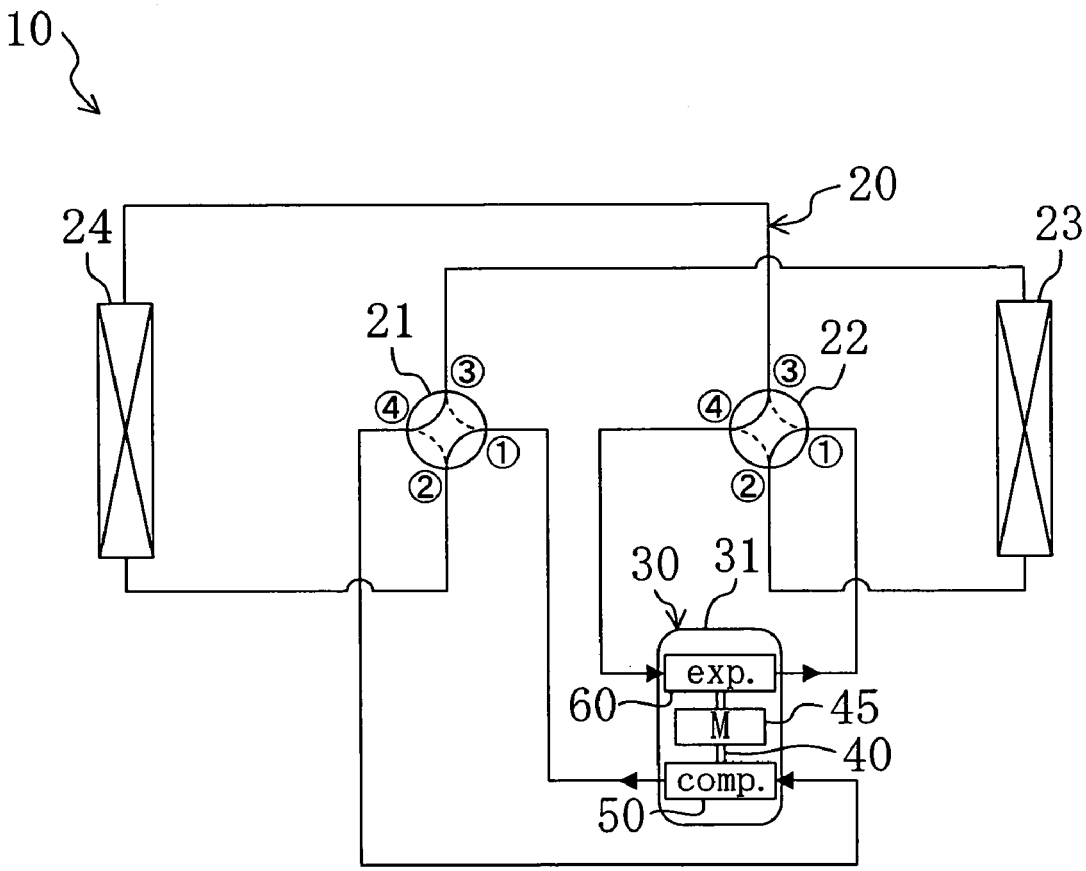
FIG. 1 is a piping diagram showing the configuration of a refrigerant circuit in an embodiment.

20 refrigerant circuit
31 casing
38 first space
39 second space
40 shaft (rotary shaft)
50 compression mechanism
60 expansion mechanism
71 first cylinder
72 first expansion chamber
75 first piston
76 first blade
78 bush hole (through hole)
81 second cylinder
82 second expansion chamber
85 second piston
86 second blade
88 bush hole (through hole)
90 oil feeding channel
93 third branch channel
94 oil pump
111 connection channel
114 oil introduction channel

BEST MODE FOR CARRYING OUT THE INVENTION

An embodiment of the present invention will be described below in detail with reference to the drawings. This embodiment is directed to an air conditioner (10) including a compression/expansion unit (30) that is a fluid machine according to the present invention.

<General Structure of Air Conditioner>

As shown in FIG. 1, the air conditioner (1) according to this embodiment includes a refrigerant circuit (20). Connected in the refrigerant circuit (20) are the compression/expansion unit (30), an outdoor heat exchanger (23), an indoor heat exchanger (24), a first four-way selector valve (21) and a second four-way selector valve (22). Furthermore, the refrigerant circuit (20) is filled with carbon dioxide ($CO_2$) as refrigerant.

The compression/expansion unit (30) includes a casing (31) formed in the shape of a vertically long, cylindrical, closed container. Contained in the casing (31) are a compression mechanism (50), an expansion mechanism (60) and an electric motor (45). The expansion mechanism (60) is a positive displacement expander according to the present invention. Inside the casing (31), the compression mechanism (50), the electric motor (45) and the expansion mechanism (60) are arranged in bottom to top order. The details of the compression/expansion unit (30) will be described later.

In the refrigerant circuit (20), the compression mechanism (50) is connected at its discharge side to the first port of the first four-way selector valve (21) and connected at its suction side to the fourth port of the first four-way selector valve (21). On the other hand, the expansion mechanism (60) is connected at its outflow side to the first port of the second four-way selector valve (22) and connected at its inflow side to the fourth port of the second four-way selector valve (22).

Furthermore, in the refrigerant circuit (20), the outdoor heat exchanger (23) is connected at one end to the second port of the second four-way selector valve (22) and connected at the other end to the third port of the first four-way selector valve (21). On the other hand, the indoor heat exchanger (24) is connected at one end to the second port of the first four-way selector valve (21) and connected at the other end to the third port of the second four-way selector valve (22).

The first four-way selector valve (21) and the second four-way selector valve (22) are each configured to be switchable between a position in which the first and second ports are communicated with each other and the third and fourth ports are communicated with each other (the position shown in the solid lines in FIG. 1) and a position in which the first and third ports are communicated with each other and the second and fourth ports are communicated with each other (the position shown in the broken lines in FIG. 1).

<Structure of Compression/Expansion Unit>

Figure 2:
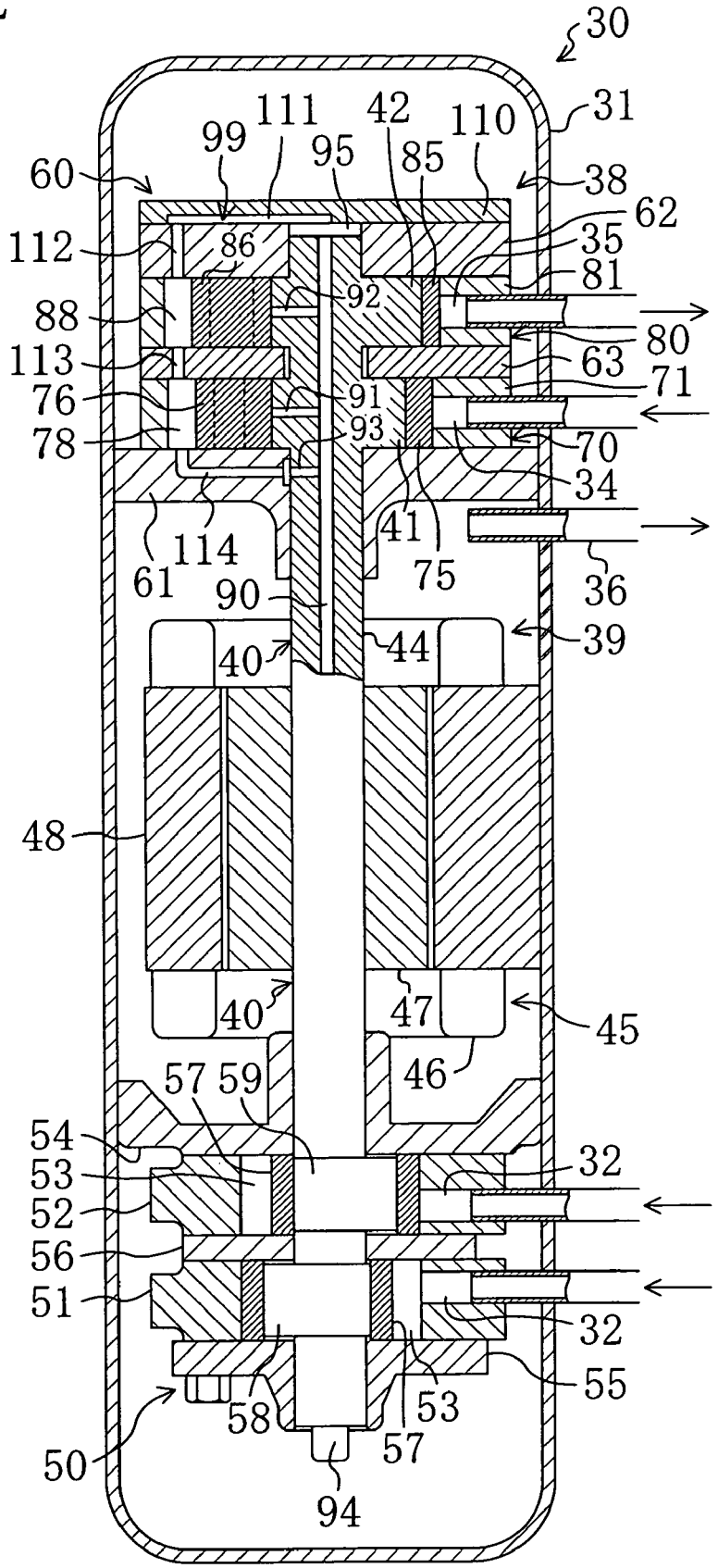
FIG. 2 is a longitudinal cross-sectional view showing a schematic structure of a compression/expansion unit in the above embodiment.

As shown in FIG. 2, the compression/expansion unit (30) includes a casing (31) that is a vertically long, cylindrical, closed container. Inside the casing (31), the compression mechanism (50), the electric motor (45) and the expansion mechanism (60) are arranged in bottom to top order. Furthermore, refrigerating machine oil serving as lubricating oil is accumulated at the bottom of the casing (31). In other words, inside the casing (31), refrigerating machine oil is accumulated towards the compression mechanism (50).

The internal space of the casing (31) is partitioned into upper and lower spaces by a front head (61) of the expansion mechanism (60). The upper space constitutes a first space (38) and the lower space constitutes a second space (39). Disposed in the first space (38) is the expansion mechanism (60) and disposed in the second space (39) are the compression mechanism (50) and the electric motor (45). The first space (38) and the second space (39) are not hermetically separated from each other but have approximately equal internal pressures.

Attached to the casing (31) is a discharge pipe (36). The discharge pipe (36) is disposed between the electric motor (45) and the expansion mechanism (60) and communicated with the second space (39) in the casing (31). Furthermore, the discharge pipe (36) is formed in the shape of a relatively short, straight tube and placed in an approximately horizontal position.

The electric motor (45) is disposed in a longitudinally middle part of the casing (31). The electric motor (45) is composed of a stator (46) and a rotor (47). The stator (46) is fixed to the casing (31), such as by shrink fitting. The outer periphery of the stator (46) is partly cut away to form a core cut part (48). A clearance is formed between the core cut part (48) and the inner periphery of the casing (31). The rotor (47) is placed inside the stator (46). The rotor (47) is coaxially passed through by a main spindle (44) of a shaft (40).

The shaft (40) constitutes a rotary shaft. The shaft (40) includes two lower eccentric parts (58, 59) formed towards its lower end and two large-diameter eccentric parts (41, 42) formed towards its upper end. A lower end part of the shaft (40) having the lower eccentric parts (58, 59) formed thereat is engaged with the compression mechanism (50), while an upper end part thereof having the large-diameter eccentric parts (41, 42) formed thereat is engaged with the expansion mechanism (60).

The two lower eccentric parts (58, 59) are formed with a larger diameter than the main spindle (44), in which the lower of the two constitutes a first lower eccentric part (58) and the upper constitutes a second lower eccentric part (59). The first lower eccentric part (58) and the second lower eccentric part (59) have opposite directions of eccentricity with respect to the axis of the main spindle (44).

The two large-diameter eccentric parts (41, 42) are formed with a larger diameter than the main spindle (44), in which the lower of the two constitutes a first large-diameter eccentric part (41) and the upper constitutes a second large-diameter eccentric part (42). The first large-diameter eccentric part (41) and the second large-diameter eccentric part (42) have the same direction of eccentricity. The second large-diameter eccentric part (42) has a larger outer diameter than the first large-diameter eccentric part (41). Furthermore, in terms of degree of eccentricity with respect to the axis of the main spindle (44), the second large-diameter eccentric part (42) is larger than the first large-diameter eccentric part (41).

The shaft (40) has an oil feeding channel (90) formed therein. The oil feeding channel (90) extends along the shaft (40). Its beginning opens at the lower end of the shaft (40) and its end opens at the upper end surface of the shaft (40). An oil pump is provided at the lower end of the shaft (40). The oil pump is constituted by a centrifugal pump that is a type of non-positive displacement pump. Specifically, a beginning part of the oil feeding channel (90) is formed to extend from the axis of the shaft (40) towards the outer periphery thereof and constitutes the oil pump composed of a centrifugal pump.

The compression mechanism (50) is constituted by a rolling piston rotary compressor. The compression mechanism (50) includes two cylinders (51, 52) and two pistons (57). In the compression mechanism (50), a rear head (55), the first cylinder (51), a middle plate (56), the second cylinder (52) and a front head (54) are stacked in bottom to top order.

Disposed in the internal spaces of the first and second cylinders (51, 52) are cylindrical pistons (57), one in each internal space. Although not shown, a plate-shaped blade extends from the side surface of the piston (57) and is supported through a rolling bush to the associated cylinder (51, 52). The piston (57) in the first cylinder (51) engages with the first lower eccentric part (58) of the shaft (40). On the other hand, the piston (57) in the second cylinder (52) engages with the second lower eccentric part (59) of the shaft (40). Each of the pistons (57, 57) is in slidable contact at its inner periphery with the outer periphery of the associated lower eccentric part (58, 59) and in slidable contact at its outer periphery with the inner periphery of the associated cylinder (51, 52). Thus, a compression chamber (53) is defined between the outer periphery of each of the pistons (57, 57) and the inner periphery of the associated cylinder (51, 52).

Formed in the first and second cylinders (51, 52) are suction ports (32), one in each cylinder. Each suction port (32) radially passes through the associated cylinder (51, 52) and its distal end opens at the inner periphery of the cylinder (51, 52). Furthermore, each suction port (32) is extended to the outside of the casing (31) by a pipe.

Formed in the front head (54) and the rear head (55) are discharge ports, one in each head. The discharge port in the front head (54) brings the compression chamber (53) in the second cylinder (52) into communication with the second space (39). The discharge port in the rear head (55) brings the compression chamber (53) in the first cylinder (51) into communication with the second space (39). Furthermore, each discharge port is provided at its distal end with a discharge valve composed of a lead valve, and configured to be opened and closed by the discharge valve. In FIG. 2, the discharge ports and discharge valves are not given. Gas refrigerant discharged from the compression mechanism (50) into the second space (39) is sent out through the discharge pipe (36) from the compression/expansion unit (30).

As described previously, refrigerating machine oil is fed through the oil feeding channel (90) to the compression mechanism (50). Although not shown, channels branched from the oil feeding channel (90) open at the outer peripheries of the lower eccentric parts (58, 59) and the outer periphery of the main spindle (44). The refrigerating machine oil is fed through these channels to the sliding surfaces between each lower eccentric part (58, 59) and the associated piston (57, 57) and the sliding surfaces between the main spindle (44) and each of the front head (54) and the rear head (55).

Figure 3:
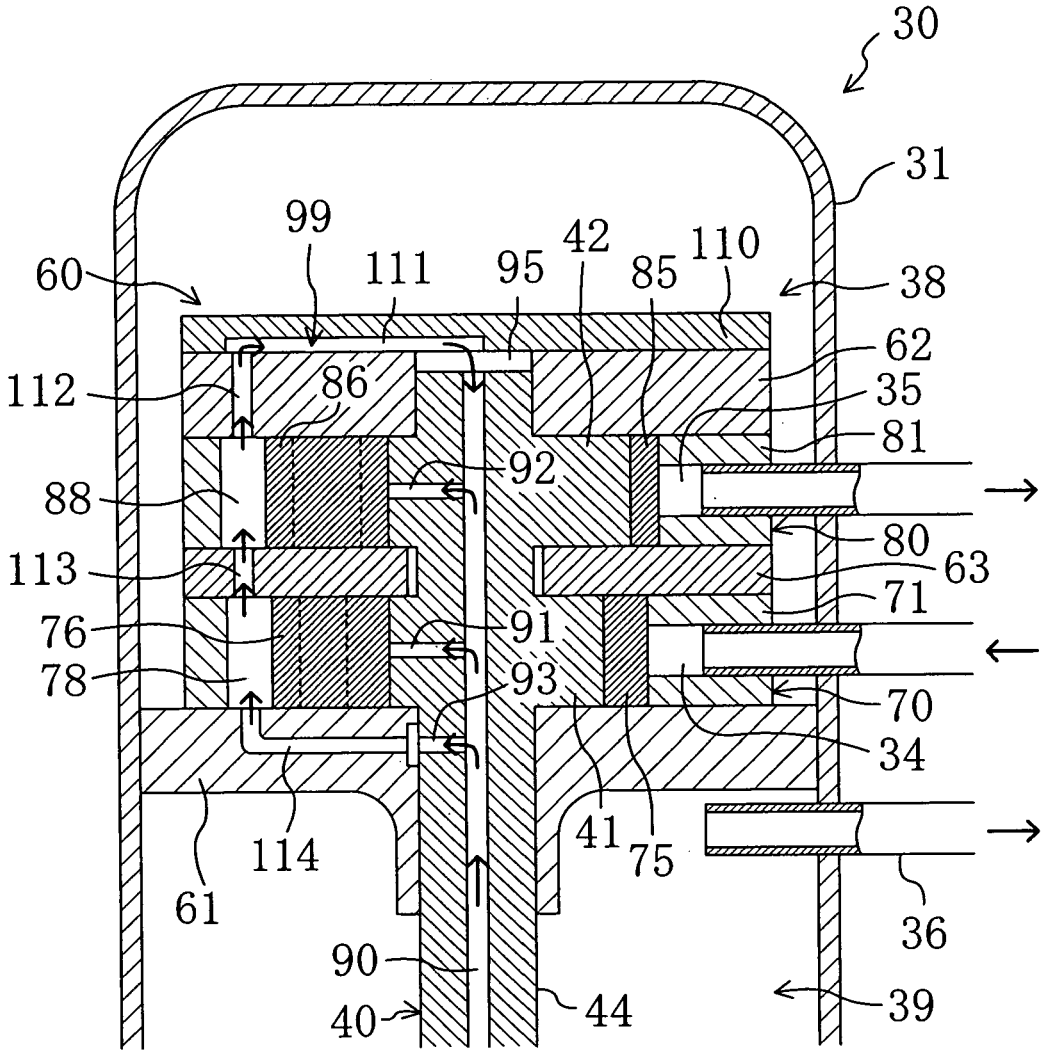
FIG. 3 is a longitudinal cross-sectional view showing a schematic structure of an expansion mechanism in the above embodiment.

As also shown in FIG. 3, the expansion mechanism (60) is constituted by a so-called rolling piston rotary expander. The expansion mechanism (60) includes two cylinders (71, 72) and two pistons (75, 85) in two cylinder-piston pairs. The expansion mechanism (60) further includes the front head (61), a middle plate (63), a rear head (62) and a top plate (110).

In the expansion mechanism (60), the front head (61), the first cylinder (71), the middle plate (63), the second cylinder (81), the rear head (62) and the top plate (110) are stacked in bottom to top order. In this state, the first cylinder (71) is closed at the lower end surface by the front head (61) and closed at the upper end surface by the middle plate (63). On the other hand, the second cylinder (81) is closed at the lower end surface by the middle plate (63) and closed at the upper end surface by the rear head (62). Furthermore, the second cylinder (81) has a larger inner diameter than the first cylinder (71).

The shaft (40) passes through the front head (61), the first cylinder (71), the middle plate (63) and the second cylinder (81) that are stacked. Formed in the center of the rear head (62) is a center hole passing through the rear head (62) in the thickness direction. The upper end of the shaft (40) is inserted into the center hole of the rear head (62). In the center hole, an end space (95) is formed between the upper end surface of the shaft (40) and the bottom surface of the top plate (110). Furthermore, the first large-diameter eccentric part (41) of the shaft (40) is located inside the first cylinder (71) and the second large-diameter eccentric part (42) thereof is located inside the second cylinder (81).

The top plate (110) has a connection channel (111) formed therein. The connection channel (111) is formed by incising the bottom surface of the top plate (110). Furthermore, the connection channel (111) is overlapped at its beginning with the end space (95) and extends towards the outer periphery of the top plate (110).

In the expansion mechanism (60), a first communication hole (112) is formed in the rear head (62) and a second communication hole (113) is formed in the middle plate (63). The first communication hole (112) passes through the rear head (62) in the thickness direction and brings the end of the connection channel (111) into communication with a bush hole (88) in the second cylinder (81). The second communication hole (113) passes through the middle plate (63) in the thickness direction and brings the bush hole (88) in the second cylinder (81) into communication with a bush hole (78) in the first cylinder (71). The bush holes (78, 88) in the cylinders (71, 81) will be described later.

The front head (61) has an oil introduction channel (114) formed therein. The beginning of the oil introduction channel (114) opens at the side wall of the center hole in which the main spindle (44) of the shaft (40) is inserted. The oil introduction channel (114) extends from its beginning towards the outer periphery of the front head (61). The end of the oil introduction channel (114) bents upward, opens at the top surface of the front head (61) and is communicated with the bush hole (78) in the first cylinder (71).

Figure 4:
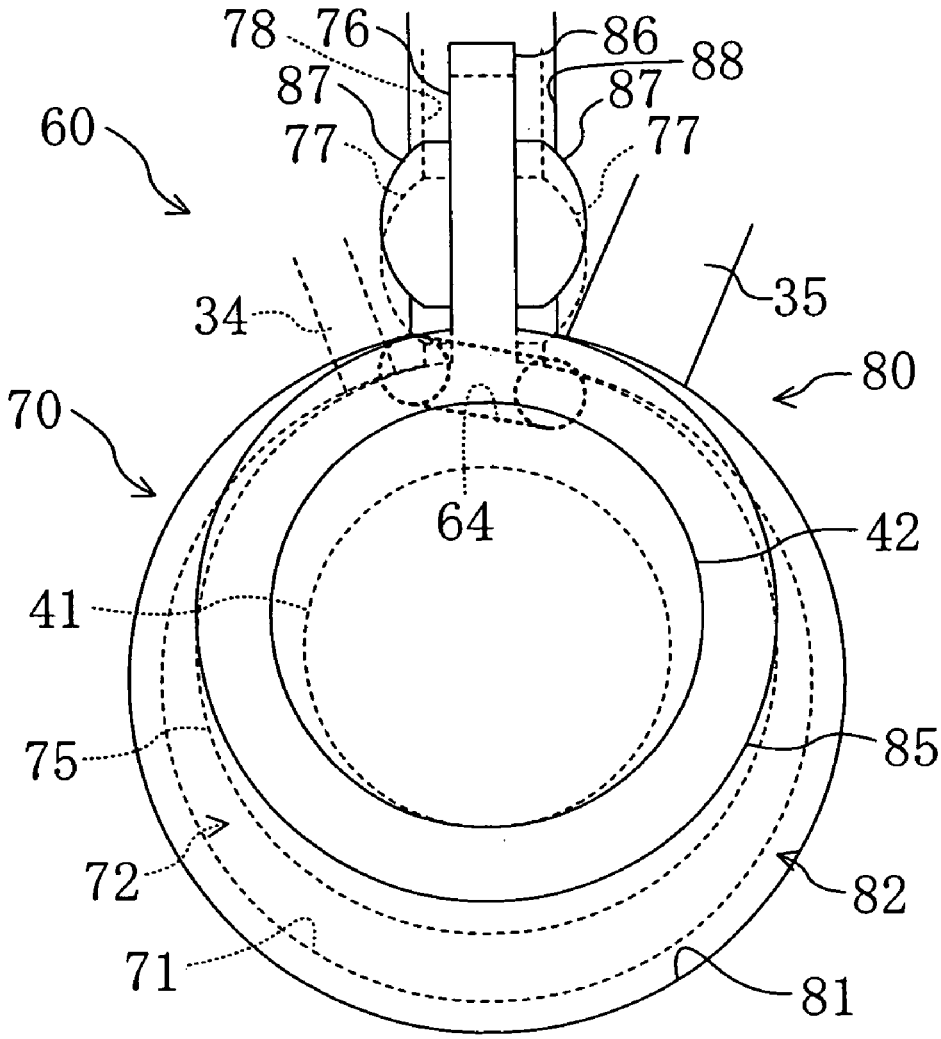
FIG. 4 is an enlarged view showing an essential part of the expansion mechanism in the above embodiment.
Figure 5:
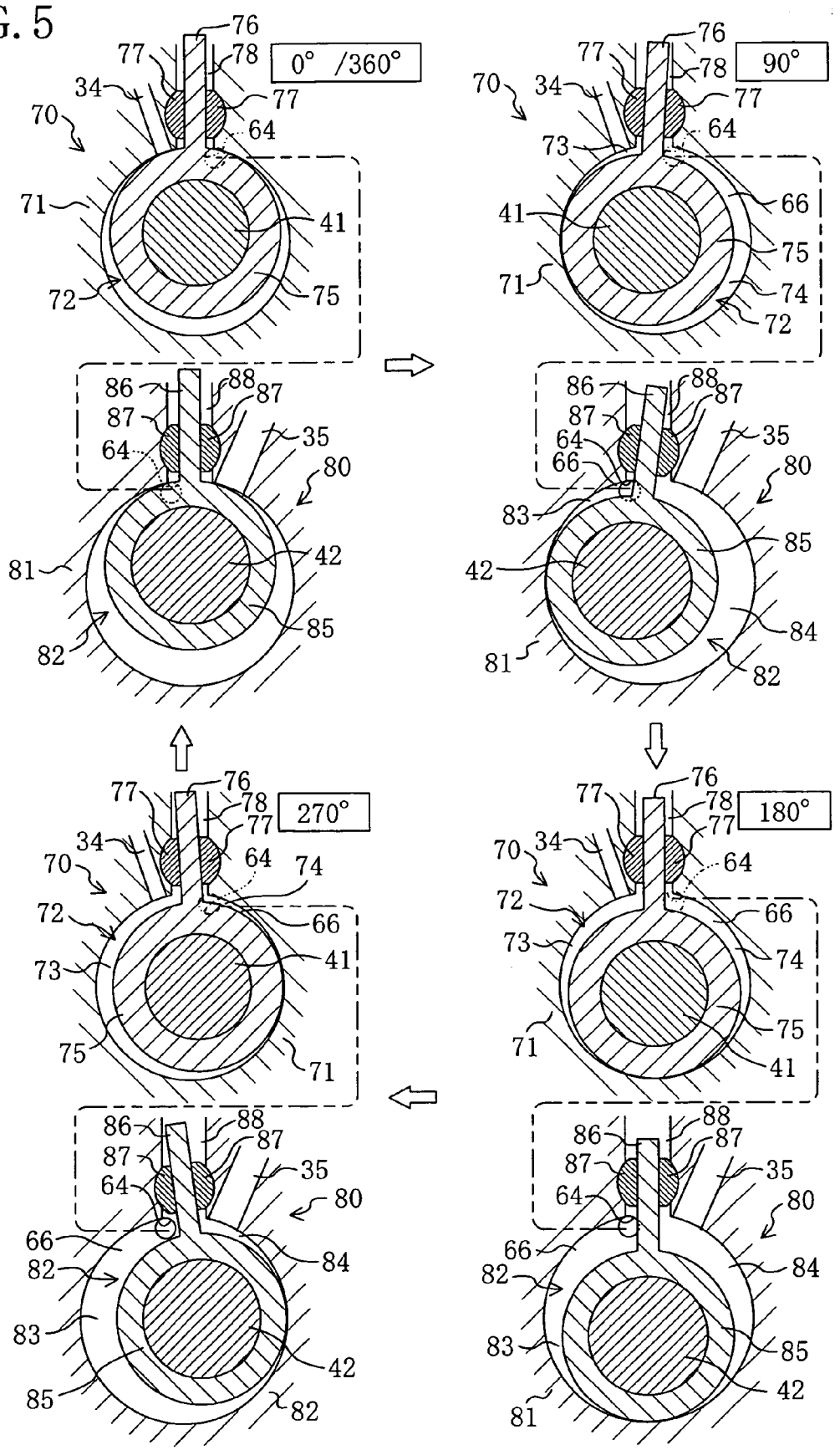
FIG. 5 is schematic transverse cross-sectional views of the expansion mechanism in the above embodiment, showing the states of the expansion mechanism at every 90° of angle of rotation of a shaft.

As also shown in FIGS. 4 and 5, the first piston (75) and the second piston (85) are placed in the first cylinder (71) and the second cylinder (81), respectively. The first and second pistons (75, 85) are each formed in an annular or cylindrical shape. The outer diameters of the first piston (75) and the second piston (85) are equal to each other. The inner diameter of the first piston (75) is approximately equal to the outer diameter of the first large-diameter eccentric part (41), and the inner diameter of the second piston (85) is approximately equal to the outer diameter of the second large-diameter eccentric part (42). The first piston (75) and the second piston (85) are passed through by the first large-diameter eccentric part (41) and the second large-diameter eccentric part (42), respectively.

The first piston (75) is slidably engaged at the outer periphery with the inner periphery of the first cylinder (71), is in slidable contact at one end surface thereof with the front head (61) and is in slidable contact at the other end surface with the middle plate (63). In the first cylinder (71), its inner periphery defines a first expansion chamber (72) together with the outer periphery of the first piston (75). On the other hand, the second piston (85) is slidably engaged at the outer periphery with the inner periphery of the second cylinder (81), is in slidably contact at one end surface thereof with the rear head (62) and is in slidable contact at the other end surface with the middle plate (63). In the second cylinder (81), its inner periphery defines a second expansion chamber (82) together with the outer periphery of the second piston (85).

The first and second pistons (75, 85) are integrally formed with blades (76, 86), one for each piston. Each blade (76, 86) is formed in the shape of a plate extending radially from the associated piston (75, 85) and extends outward from the outer periphery of the piston (75, 85). The blade (76) of the first piston (75) and the blade (86) of the second piston (85) are inserted into the bush hole (78) of the first cylinder (71) and the bush hole (88) of the second cylinder (81), respectively. The bush hole (78, 88) of each cylinder (71, 81) passes through the associated cylinder (71, 81) in the thickness direction and opens at the inner periphery of the cylinder (71, 81). These bush holes (78, 88) constitute through holes.

The cylinders (71, 81) are provided with pairs of bushes (77, 87), each cylinder with one pair of bushes. Each bush (77, 87) is a small piece formed so that its inside surface is plane and its outside surface is arcuate. In each cylinder (71, 81), the pair of bushes (77, 87) are inserted into the associated bush hole (78, 88) to sandwich the associated blade (76, 86) therebetween. Each bush (77, 87) slides with the inside surface on the associated blade (76, 86) and slides with the outside surface on the associated cylinder (71, 81). Each blade (76, 86) integral with the piston (75, 85) is supported through the associated bushes (77, 87) to the associated cylinder (71, 81) and is free to angularly move with respect to and free to enter and retract from the cylinder (71, 81).

The first expansion chamber (72) in the first cylinder (71) is partitioned by the first blade (76) integral with the first piston (75); a region thereof to the left of the first blade (76) in FIGS. 4 and 5 provides a first high-pressure chamber (73) of relatively high pressure and a region thereof to the right of the first blade (76) provides a first low-pressure chamber (74) of relatively low pressure. The second expansion chamber (82) in the second cylinder (81) is partitioned by the second blade (86) integral with the second piston (85); a region thereof to the left of the second blade (86) in FIGS. 4 and 5 provides a second high-pressure chamber (83) of relatively high pressure and a region thereof to the right of the second blade (86) provides a second low-pressure chamber (84) of relatively low pressure.

The first cylinder (71) and the second cylinder (81) are arranged in postures in which the circumferential relative positions between their associated pairs of bushes (77, 87) coincide with each other. In other words, the angle of displacement of the second cylinder (81) relative to the first cylinder (71) is 0°. As described previously, the first large-diameter eccentric part (41) and the second large-diameter eccentric part (42) have the same direction of eccentricity with respect to the axis of the main spindle (44). Therefore, when the first blade (76) comes to a most retracted position towards the outside of the first cylinder (71), the second blade (86) concurrently comes to a most retracted position towards the outside of the second cylinder (81).

The first cylinder (71) has an inlet port (34) formed therein. The inlet port (34) opens at the inner periphery of the first cylinder (71) slightly to the left of the bushes (77) in FIGS. 4 and 5. The inlet port (34) can be communicated with the first high-pressure chamber (73). On the other hand, the second chamber (81) has an outlet port (35) formed therein. The outlet port (35) opens at the inner periphery of the second cylinder (81) slightly to the right of the bushes (87) in FIGS. 4 and 5. The outlet port (35) can be communicated with the second low-pressure chamber (84).

The middle plate (63) has a communicating channel (64) formed therein. The communicating channel (64) passes through the middle plate (63) in the thickness direction. In a surface of the middle plate (63) facing the first cylinder (71), one end of the communicating channel (64) opens at a position to the right of the first blade (76). In another surface of the middle plate (63) facing the second cylinder (81), the other end of the communicating channel (64) opens at a position to the left of the second blade (86). Furthermore, as shown in FIG. 4, the communicating channel (64) extends obliquely with respect to the thickness direction of the middle plate (63) and brings about communication between the first low-pressure chamber (74) and the second high-pressure chamber (83).

As shown in FIGS. 2 and 3, the shaft (40) has three branch channels (91, 92, 93) formed to branch off from the oil feeding channel (90). Each branch channel (91, 92, 93) extends from the oil feeding channel (90) in the radial direction of the shaft (40). The first branch channel (91) and the second branch channel (92) open at the outer periphery of the first large-diameter eccentric part (41) and the outer periphery of the second large-diameter eccentric part (42), respectively. The third branch channel (93) opens at the outer periphery of the main spindle (44) slightly below the first large-diameter eccentric part (41). The position of the opening of the third branch channel (93) at the outer periphery of the main spindle (44) is level with the beginning of the oil introduction channel (114).

Through these branch channels (91, 92, 93), refrigerating machine oil in the oil feeding channel (90) is fed to the sliding surfaces between the first large-diameter eccentric part (41) and the first piston (75), the sliding surfaces between the second large-diameter eccentric part (42) and the second piston (85) and the sliding surfaces between the main spindle (44) and the front head (61). Furthermore, refrigerating machine oil discharged through the third branch channel (93) is introduced also into the oil introduction channel (114).

In the expansion mechanism (60) in this embodiment configured as described above, a first rotary mechanism (70) is constituted by the first cylinder (71) and the bushes (77), first piston (75) and first blade (76) that are provided in association with the first cylinder (71). Furthermore, a second rotary mechanism (80) is constituted by the second cylinder (81) and the bushes (87), second piston (85) and second blade (86) that are provided in association with the second cylinder (81).

Operational Behavior

A description is given of the behaviors of the air conditioner (10). Here, the description is given first of the behavior of the air conditioner (10) in cooling operation, then of the behavior thereof in heating operation and then the behavior of the expansion mechanism (60).

<Cooling Operation>

In cooling operation, the first four-way selector valve (21) and the second four-way selector valve (22) are switched to the positions shown in the broken lines in FIG. 1. When in this state the electric motor (45) of the compression/expansion unit (30) is energized, refrigerant circulates through the refrigerant circuit (20) so that the refrigerant circuit (20) operates in a vapor compression refrigeration cycle.

The refrigerant compressed by the compression mechanism (50) is discharged through the discharge pipe (36) out of the compression/expansion unit (30). In this state, the refrigerant pressure becomes higher than the critical pressure. The discharged refrigerant is sent to the outdoor heat exchanger (23) and therein releases heat to the outdoor air. The high-pressure refrigerant having released heat in the outdoor heat exchanger (23) passes through an inlet pipe and then flows into the expansion mechanism (60). In the expansion mechanism (60), the high-pressure refrigerant expands and power is recovered from the high-pressure refrigerant. The low-pressure refrigerant obtained by expansion is sent through an outlet pipe to the indoor heat exchanger (24). In the indoor heat exchanger (24), the refrigerant having flowed therein takes heat from room air to evaporate, thereby cooling the room air. The low-pressure gas refrigerant having flowed out of the indoor heat exchanger (24) is sucked through the suction port (32) into the compression mechanism (50). The compression mechanism (50) compresses the sucked refrigerant and discharges it.

<Heating Operation>

In heating operation, the first four-way selector valve (21) and the second four-way selector valve (22) are switched to the positions shown in the solid lines in FIG. 1. When in this state the electric motor (45) of the compression/expansion unit (30) is energized, refrigerant circulates through the refrigerant circuit (20) so that the refrigerant circuit (20) operates in a vapor compression refrigeration cycle.

The refrigerant compressed by the compression mechanism (50) is discharged through the discharge pipe (36) out of the compression/expansion unit (30). In this state, the refrigerant pressure becomes higher than the critical pressure. The discharged refrigerant is sent to the indoor heat exchanger (24). In the indoor heat exchanger (24), the refrigerant having flowed therein releases heat to room air, thereby heating the room air. The refrigerant having released heat in the indoor heat exchanger (24) passes through the inlet pipe and then flows into the expansion mechanism (60). In the expansion mechanism (60), high-pressure refrigerant expands and power is recovered from the high-pressure refrigerant. The low-pressure refrigerant obtained by expansion is sent through the outlet pipe to the outdoor heat exchanger (23) and therein takes heat from the outdoor air to evaporate. The low-pressure gas refrigerant having flowed out of the outdoor heat exchanger (23) is sucked through the suction port (32) into the compression mechanism (50). The compression mechanism (50) compresses the sucked refrigerant and discharges it.

<Behavior of Expansion Mechanism>

A description is given of the behavior of the expansion mechanism (60) with reference to FIG. 5.

First, a description is given of the course of flow of supercritical high-pressure refrigerant into the first high-pressure chamber (73) of the first rotary mechanism (70). When the shaft (40) rotates slightly from an angle of rotation of 0°, the contact point between the first piston (75) and the first cylinder (71) passes through the opening of the inlet port (34) so that high-pressure refrigerant begins to flow through the inlet port (34) into the first high-pressure chamber (73). Then, as the angle of rotation of the shaft (40) gradually increases to 90°, 180° and 270°, high-pressure refrigerant flows more into the first high-pressure chamber (73). The flow of the high-pressure refrigerant into the first high-pressure chamber (73) continues until the angle of rotation of the shaft (40) reaches 360°.

Next, a description is given of the course of refrigerant expansion in the expansion mechanism (60). When the shaft (40) rotates slightly from an angle of rotation of 0°, the first low-pressure chamber (74) and the second high-pressure chamber (83) are communicated through the communicating channel (64) with each other so that the refrigerant begins to flow from the first low-pressure chamber (74) into the second high-pressure chamber (83). Then, as the angle of rotation of the shaft (40) gradually increases to 90°, 180° and 270°, the first low-pressure chamber (74) gradually decreases its volume and, concurrently, the second high-pressure chamber (83) gradually increases its volume, resulting in gradually increasing volume of the expansion chamber (66). The increase in the volume of the expansion chamber (66) continues until just before the angle of rotation of the shaft (40) reaches 360°. The refrigerant in the expansion chamber (66) expands during the increase in the volume of the expansion chamber (66). The expansion of the refrigerant drives the shaft (40) into rotation. Thus, the refrigerant in the first low-pressure chamber (74) flows through the communicating channel (64) into the second high-pressure chamber (83) while expanding.

Next, a description is given of the course of flow of refrigerant out of the second low-pressure chamber (84) of the second rotary mechanism (80). The second low-pressure chamber (84) starts to be communicated with the outlet port (35) at a point of time when the shaft (40) is at an angle of rotation of 0°. In other words, the refrigerant starts to flow out of the second low-pressure chamber (84) to the outlet port (35). Then, during the period when the angle of rotation of the shaft (40) gradually increases to 90°, 180° and 270° and until it reaches 360°, low-pressure refrigerant obtained by expansion flows out of the second low-pressure chamber (84).

<Oil Feeding Behavior in Compression/Expansion Unit>

A description is given of the behavior of feeding of refrigerating machine oil to the compression mechanism (50) and the expansion mechanism (60) in the compression/expansion unit (30).

Refrigerating machine oil is accumulated at the bottom of the casing (31) (i.e., the bottom of the second space (39)). The temperature of the refrigerating machine oil is approximately equal to the temperature (approximately 90° C.) of refrigerant discharged from the compression mechanism (50) to the second space (39).

When the shaft (40) rotates, refrigerating machine oil accumulated at the bottom of the casing (31) is sucked into the oil feeding channel (90). The refrigerating machine oil flowing upward through the oil feeding channel (90) is partly fed to the compression mechanism (50). The refrigerating machine oil fed to the compression mechanism (50) is used for lubrication of the sliding surfaces between each lower eccentric part (58, 59) and the associated piston (57, 57) and the sliding surfaces between the main spindle (44) and each of the front head (54) and the rear head (55).

The remaining refrigerating machine oil not fed to the compression mechanism (50) flows further upward through the oil feeding channel (90) and is fed to the expansion mechanism (60). In the expansion mechanism (60), the refrigerating machine oil having flowed through the oil feeding channel (90) diverges and flows into the three branch channels (91, 92, 93).

The refrigerating machine oil having flowed into the first branch channel (91) passes through the clearance between the first large-diameter eccentric part (41) and the first piston (75) and the clearances between the end surfaces of the first piston (75) and the opposed front head (61) and middle plate (63) in this order and then enters the first expansion chamber (72). The refrigerating machine oil having entered the first expansion chamber (72) lubricates the sliding surfaces between the first piston (75) and the first cylinder (71). Furthermore, the refrigerating machine oil, together with refrigerant in the first expansion chamber (72), is sent through the communicating channel (64) to the second expansion chamber (82).

The refrigerating machine oil having flowed into the second branch channel (92) passes through the clearance between the second large-diameter eccentric part (42) and the second piston (85) and the clearances between the end surfaces of the second piston (85) and the opposed rear head (62) and middle plate (63) in this order and then enters the second expansion chamber (82). As described above, refrigerating machine oil is introduced into the second expansion chamber (82) also from the first expansion chamber (72). The refrigerating machine oil having entered the second expansion chamber (82) lubricates the sliding surfaces between the second piston (85) and the second cylinder (81). Furthermore, the refrigerating machine oil, together with refrigerant in the second expansion chamber (82), is discharged through the outlet port (35) out of the expansion mechanism (60).

The refrigerating machine oil having flowed into the third branch channel (93) flows into the oil introduction channel (114) in the front head (61). In this case, the refrigerating machine oil flows into the oil introduction channel (114) with its pressure raised by a centrifugal force due to rotation of the shaft (40). The refrigerating machine oil passes through the oil introduction channel (114) and then flows into the bush hole (78) in the first cylinder (71). Part of the refrigerating machine oil having flowed into the bush hole (78) is fed to the sliding surfaces between the first blade (76) and each bush (77) and the sliding surfaces between each bush (77) and the first cylinder (71), and the rest thereof flows through the second communication hole (113) into the bush hole (88) in the second cylinder (81). Part of the refrigerating machine oil having flowed into the bush hole (88) is fed to the sliding surfaces between the second blade (86) and each bush (87) and the sliding surfaces between each bush (87) and the second cylinder (81), and the rest thereof flows through the first communication hole (112), the connection channel (111) and the end space (95) in this order and is then sent back to the oil feeding channel (90) in the shaft (40).

In the expansion mechanism (60), a flow passage (99) for refrigerating machine oil constituted by the oil introduction channel (114), the bush hole (78) in the first cylinder (71), the second communication hole (113), the bush hole (88) in the second cylinder (81), the first communication hole (112), the connection channel (111) and the end space (95) is connected at both ends thereof to the oil feeding channel (90). In other words, in the expansion mechanism (60), a flow path of a closed loop is formed by the flow passage (99) and the oil feeding channel (90). Then, the refrigerating machine oil having been used for lubrication of the expansion mechanism (60), together with refrigerant after expansion, is discharged through the outlet port (35) out of the expansion mechanism (60).

The refrigerating machine oil discharged out of the expansion mechanism (60) passes through one of the outdoor heat exchanger (23) and the indoor heat exchanger (24) that serves as an evaporator, and, together with refrigerant, is then sucked through the suction port (32) into the compression mechanism (50). The refrigerating machine oil having entered the compression chamber (53) in the compression mechanism (50), together with refrigerant after compression, is discharged to the second space (39) in the casing (31). The refrigerating machine oil discharged from the compression mechanism (50) together with refrigerant is separated from the refrigerant during passage through the clearance between the casing (31) and the stator (46) and the clearance between the stator (46) and the rotor (47) and flows down towards the bottom of the casing (31).

Effects of Embodiment

In the compression/expansion unit (30), the refrigerating machine oil fed to the expansion mechanism (60) is sent, through the refrigerant circuit (20) in which the compression/expansion unit (30) is connected, back to the inside of the casing (31). In other words, even if the compression/expansion unit (30) itself is not provided with a passage or the like for returning the refrigerating machine oil from the expansion mechanism (60) side in the casing (31) to the compression mechanism (50) side therein, the refrigerating machine oil fed to the expansion mechanism (60) is sent back to the inside of the casing (31). Therefore, according to this embodiment, any passage or the like for returning the refrigerating machine oil from the expansion mechanism (60) side in the casing (31) to the compression mechanism (50) side therein can be eliminated from the compression/expansion unit (30), which simplifies the structure of the compression/expansion unit (30).

Furthermore, in the compression/expansion unit (30), the refrigerating machine oil is introduced through the third branch channel (93) extending in the radial direction of the shaft (40) into the oil introduction channel (114). Therefore, the refrigerating machine oil can be fed to the sliding surfaces of the blades (76, 86) using a centrifugal force caused by the rotation of the shaft (40). Hence, according to this embodiment, the driven surfaces of the blades (76, 86) can be certainly lubricated, which enhances the reliability of the compression/expansion unit (30).

Furthermore, the compression/expansion unit (30) has a flow path for refrigerating machine oil formed to allow the oil to flow from the oil feeding channel (90) through the third branch channel (93), the oil introduction channel (114), the through holes (78, 88) and the connection channel (111) in this order and back to the oil feeding channel (90). Therefore, according to this embodiment, the refrigerating machine oil can be more certainly fed to the sliding surfaces of the blades (76, 86), which further enhances the reliability of the compression/expansion unit (30).

In the compression/expansion unit (30), the refrigerating machine oil discharged from the expansion mechanism (60) directly flows into the compression mechanism (50) without contact with high-temperature and high-pressure refrigerant discharged from the compression mechanism (50) to the second space (39). In other words, relatively low-temperature refrigerating machine oil discharged from the expansion mechanism (60) flows into the compression mechanism (50) without contact with high-temperature and high-pressure refrigerant discharged from the compression mechanism (50) to the second space (39). Therefore, according to this embodiment, it can be avoided that the refrigerant discharged from the compression mechanism (50) is cooled by the refrigerating machine oil discharged from the expansion mechanism (60). As a result, in the heating operation in which a room is heated using refrigerant discharged from the compression mechanism (50), the heating capacity can be enhanced.

Furthermore, in the compression/expansion unit (30), the oil pump is constituted by a non-positive displacement pump. Therefore, the amount of refrigerating machine oil fed to the oil feeding channel (90) by the oil pump varies not only with the rotational speed of the shaft (40) but also with the internal pressure of the oil feeding channel (90) and the internal pressure of the casing (31). Therefore, according to this embodiment, the amount of refrigerating machine oil fed through the oil feeding channel (90) to the expansion mechanism (60) can be appropriately controlled according to the operating conditions of the compression/expansion unit (30). As a result, the amount of refrigerating machine oil discharged from the expansion mechanism (60) together with refrigerant can be reduced.

Modification of Embodiment

In the above embodiment, the expansion mechanism (60) may be constituted by a rolling piston rotary expander. In the expansion mechanism (60) in this modification, the blade (76, 86) in each of the rotary mechanisms (70, 80) is formed separately from the associated piston (75, 85). Thus, the distal end of the blade (76, 86) is pushed against the outer periphery of the associated piston (75, 85), whereby the blade (76, 86) moves forward and backward with movement of the associated piston (75, 85).

The above embodiment is merely a preferred embodiment in nature and is not intended to limit the scope, applications and use of the invention.

INDUSTRIAL APPLICABILITY

As can be seen from the above description, the present invention is useful for a fluid machine in which a compression mechanism and an expansion mechanism are contained in a single casing.

The invention claimed is:

1. A fluid machine disposed in a refrigerant circuit operating in a refrigeration cycle by circulating refrigerant therethrough, comprising:

a compression mechanism for compressing the refrigerant;

an expansion mechanism disposed above the compression mechanism for generating power by expansion of the refrigerant;

a rotary shaft coupling the compression mechanism to the expansion mechanism; and a container-shaped casing containing the compression mechanism, the expansion mechanism and the rotary shaft, the rotary shaft having an oil feeding channel foamed therein to feed lubricating oil accumulated in part of the casing located towards the compression mechanism to the expansion mechanism, the expansion mechanism being configured to introduce the lubricating oil fed through the oil feeding channel into an expansion chamber for expanding the refrigerant therein and discharge the lubricating oil together with the refrigerant after expansion, the expansion mechanism being constituted by a rotary expander including: a cylinder both ends of which are closed; a piston engaged with the rotary shaft and contained in the cylinder to form the expansion chamber; and a blade for partitioning the expansion chamber into a high-pressure chamber and a low-pressure chamber, a front head, which closes an end surface of the cylinder, and through which the rotary shaft is inserted, being arranged in a lower end of the expansion mechanism, the rotary shaft having a branch channel formed therein to be branched from the oil feeding channel and open at a portion of the outer periphery of the rotary shaft, the portion of the outer periphery sliding with the front head, the expansion mechanism having an oil introduction channel formed to introduce the lubricating oil discharged through the branch channel to the sliding surface of the blade, the cylinder having a through hole foamed therein to pass through the cylinder in a thickness direction of the cylinder and receive the blade, the oil introduction channel having an end opening into the through hole in the cylinder to feed the lubricating oil to the sliding surface of the blade, one end of the oil feeding channel opening at an end surface of the rotary shaft closer to the expansion mechanism, the expansion mechanism having a connection channel formed to communicate the through hole in the cylinder with the one end of the oil feeding channel opening at the end surface of the rotary shaft, the oil introduction channel being formed in the front head, the beginning of the oil introduction channel being open in at a side wall of a center hole formed on the front head so that the rotary shaft is inserted through the center hole, and the lubricating oil flowing in the branch channel being fed to sliding surfaces between the front head and the rotary shaft, and the oil introduction channel.

2. The fluid machine of claim 1, wherein the internal space of the casing is partitioned into a first space in which the expansion mechanism is contained and a second space in which the compression mechanism is contained and to which compressed refrigerant is discharged from the compression mechanism, and the fluid machine is configured so that the lubricating oil accumulated in the second space is fed through the oil feeding channel to the expansion mechanism.

3. The fluid machine of claim 1, wherein the rotary shaft is provided with a non-positive displacement oil pump that, by the rotation of the rotary shaft, sucks the lubricating oil and discharges the sucked lubricating oil to the oil feeding channel.

4. The fluid machine of claim 1, being disposed in the refrigerant circuit filled with carbon dioxide as the refrigerant and configured so that the compression mechanism compresses the sucked refrigerant to the critical pressure or higher and the expansion mechanism expands the high-pressure refrigerant of critical pressure or higher having flowed thereinto.

* * * * *